US005876260A

United States Patent [19]

Pepi et al.

[11] Patent Number: 5,876,260

[45] Date of Patent: Mar. 2, 1999

[54] METHOD FOR ASSEMBLING A FLAT DISPLAY SCREEN

[75] Inventors: Richard Pepi, Pourrieres; Michel Garcia, Les Milles; Jean-Frédéric Clerc, Saint Egreve; Olivier Hamon, Voreppe, all of France

[73] Assignee: Pixtech SA, Rousset, France

[21] Appl. No.: 676,265

[22] PCT Filed: Nov. 9, 1994

[86] PCT No.: PCT/FR94/01314

§ 371 Date: Oct. 4, 1996

§ 102(e) Date: Oct. 4, 1996

[87] PCT Pub. No.: WO96/15542

PCT Pub. Date: May 23, 1996

[51] Int. Cl.[6] ..... H01J 9/26

[52] U.S. Cl. ..... 445/25; 445/44

[58] Field of Search ..... 445/25, 44, 59

[56] References Cited

U.S. PATENT DOCUMENTS 4,018,490 4/1977 Berkenblit et al. ..... 445/25

*Primary Examiner*—Kenneth J. Ramsey
*Attorney, Agent, or Firm*—Plevy & Associates

[57] ABSTRACT

A method for assembling two parallel plates respectively forming the bottom and the face of a flat display screen including a degassing step of the plates and a vacuum burn-in step. The method includes the steps of subjecting a first plate to a burn-in step by electronic bombardment, moving under a vacuum the first plate so as to face a second plate, and assembling the two plates with a specific peripheral sealing joint.

16 Claims, 2 Drawing Sheets

METHOD FOR ASSEMBLING A FLAT DISPLAY SCREEN

The present invention relates to flat display screens. It more particularly relates to the assembly of two plates constituting the bottom and the viewing surface of the screen, respectively, and between which is provided an internal gap isolated from outside.

Conventionally, a flat display screen is constituted by two external rectangular plates, for example made of glass. One plate forms the viewing surface of the screen and the other plate forms the bottom provided with emission means. These two plates are assembled with a sealing joint and are spaced one from the other. For a Field Effect Display (FED), a microtip display, or a Vacuum Fluorescent Display (VFD), the gap between the two glass plates is evacuated, whereas for a plasma display, the gap is filled with a low pressure gas.

FIG. 1 is a schematic cross-sectional view representing the conventional structure of a portion of a flat display screen with microtips and FIG. 2 is a schematic cross-sectional view representing a conventional method for assembling a microtip flat display screen.

Such microtip screens are mainly constituted by a cathode plate 1 facing an anode plate 2.

The operation and the detailed structure of an example of such a microtip screen are described in U.S. Pat. No. 4,940,916 assigned to Commissariat a l'Energie Atomique.

The cathode plate 1 is constituted, onto a glass substrate 3, of cathode conductors 4 arranged in columns. The cathode conductors 4 are coated with a resistive layer (not shown) for the homogeneity of the electronic emission. The cathode is associated with a gate 5 with interposition of an insulating layer 6 to insulate the cathode conductors 4 from gate 5. Holes are respectively formed in the gate layer 5 and in the insulating layer 6 to accommodate the microtips 7 which are formed on the resistive layer. Gate 5 is arranged in rows, the intersection of a row of gate 5 and a column cathode defines a pixel. For the sake of simplification, only a few microtips 7 are represented in FIG. 1. In practice, there are several thousand microtips 7 per pixel.

The anode plate 2 is provided with phosphors 8 deposited onto electrodes 9, which are constituted by a transparent conductive layer such as indium and tin oxide (ITO) and formed on a substrate 10.

This device uses the electric field generated between the cathode 3 and gate 5 so that electrons are extracted from microtips 7 toward suitably biased phosphors 8 of anode plate 2 crossing a vacuum gap 11.

The cathode/gate and the anode are independently formed onto the two substrates 3 and 10 to constitute cathode plate 1 and anode plate 2. The plates are assembled with a peripheral sealing joint 12 (FIG. 2). A vacuum chamber 11 is provided between the two plates 1 and 2 to enable the electrons issued from the cathode to flow toward the anode.

Plates 1 and 2 are conventionally assembled as follows.

Spacers (not shown) defining the vacuum chamber 6 are first glued over gate 5. The spacers are generally constituted by glass beads regularly distributed so that the gap 11 between plates 1 and 2 is constant.

The cathode/gate plate 1 is subjected to a thermal process under a vacuum to degas the cathode and to evaporate the glue of the spacers. The thermal process is achieved under a pressure of approximately $10^{-8}$ Pa, at a temperature of approximately 450° C. for about one hour.

A similar process is applied to the anode plate 2, under a oxygen-rich atmosphere. The process causes the evaporation of the residual organic compounds included in the phosphors 8 of the anode. These organic compounds may have been used as promoters in the process of depositing the phosphors or may be pollutants resulting from subsequent processing steps.

A pumping tube 13 is placed on the free surface of cathode plate 1. Tube 13 is, for example, made of glass and is sealed at one of its opened ends in register with an aperture provided in plate 1 to form vias to gap 11. Tube 13 is subsequently used to couple a pipe 14 to make a vacuum in gap 11. Tube 13 is placed in a corner of plate 1 outside its useful surface.

A sealing joint 12, for example a fusible glass seam, is deposited at the periphery of plate 1 or 2.

Plates 1 and 2 are assembled under pressure while heating to a suitable temperature to soften seam 12. This temperature is for example 450° C. The sealing is achieved under a vacuum at a pressure of approximately $10^{-8}$ Pa for approximately one hour.

The obtained structure is subjected, through tube 13 and pipe 14, to heat pumping which causes degassing of gap 11. This step is achieved at a temperature of approximately 360° C. for approximately 15 hours. Degassing is necessary because gases are generated during the heat sealing of plates 1 and 2.

A burn-in step of anode 2 is achieved by exciting the microtips 7 of cathode 1 and pumping through tube 13 the gases generated by the phosphors 8 of the anode. The burn-in step lasts for approximately 20 hours.

Tube 13 is sealed at its free end after introduction of a getter element (not shown). The getter absorbs the impurities that may occur during the subsequent operation of the screen. The pollutants that must be absorbed by the getter mainly originate from outgassing of the molten glass seam 12, and the pollution of microtips 7 of cathode 1 during the burn-in step of anode 2 which causes a residual outgassing to occur even once tube 13 is sealed.

A drawback of this method is that the thermal and degassing processes to which the screen is subjected do not eliminate all the polluting elements. The layers of the screen thus further outgas during the operation of the screen. It has been remarked that the surface of phosphor grains 8 of anode 2 include organic elements (especially carbonates) which are not eliminated by the thermal processing of the anode in an oxygen-rich atmosphere. In addition, the organic gases present in the air at the natural state (for example carbon dioxide $CO_2$, methane $CH_4$, and carbon monoxide CO) tend to be absorbed by the phosphor grains, more particularly when the anode is handled at ambient atmosphere between the various processing steps.

Pollution of microtips 7 of cathode 1 is mainly due to the fact that the organic elements of anode 2, which are not eliminated by the thermal process, are ionized by the electronic bombardment achieved during the burn-in step. In addition, the free carbons and carbonates are not evacuated by heat pumping through tube 13 (vacuum annealing).

Pollution occurs during the life-time of the screen and cannot be totally absorbed by the getter placed in the pumping tube 13, because the distance between plates 1 and 2 (approximately 0.2 m) does not enable to fully absorb the organic pollutants which, in the form of ions for the free carbon, are in addition attracted by microtips 7 at the lowest voltage. This significantly decreases the number of electrons emitted by microtips 7 at a predetermined biasing, thereby decreasing the brightness of the screen.

In addition, the use of a tube for pumping and for receiving a getter makes the screen more bulky.

An object of the invention is to avoid the above drawbacks by providing a method for assembling a flat display screen which eliminates the pollutants, more particularly the organic pollutants, and thus increases the life-time of the screen.

The invention further provides an assembling method which avoids the use of a pumping tube, thereby decreasing the overall size of the screen.

To achieve these objects, the present invention provides a method for assembling two parallel plates respectively forming the bottom and the face of a flat display screen including a degassing step of the plates and a vacuum burn-in step, and including the following steps:

subjecting a first plate to a burn-in step by electronic bombardment, moving under a vacuum the first plate so as to face a second plate, and assembling the two plates with a specific peripheral sealing joint.

According to an embodiment of the invention, each plate is independently subjected to a degassing thermal process before being assembled, the first plate being subjected to a burn-in step after its thermal process.

According to an embodiment of the invention, the plates respectively support the cathode/gate assembly and the anode of a microtip screen.

According to an embodiment of the invention, the burning step of the anode is achieved by an electronic bombardment source that is distinct from the cathode to which it is subsequently assembled.

According to an embodiment of the invention, the electronic bombardment source is an electron gun.

According to an embodiment of the invention, the electronic bombardment source is formed by a dedicated microtip cathode for electronic emission, disposed at a distance from the anode that is significantly higher than the distance separating the anode from the cathode of an assembled screen, the anode-cathode voltage applied during the burn-in step being substantially higher than the operation voltage of the screen.

According to an embodiment of the invention, the sealing joint is formed by two foils fixed on the inner surface of the plates and protruding from the periphery of the plates. The protrusion forms an area for welding together the foils after pressing the plates together, each foil being welded to one of the plates before the thermal degassing step of the plates.

According to an embodiment of the invention, each foil is welded to a plate after deposition of a metal layer on the inner periphery of the plate.

According to an embodiment of the invention, the sealing joint is formed by a rigid frame interposed between the two plates and coated over its surfaces facing the plates with a metal layer fusible at low temperature, the sealing being achieved by an inductive heating fusion of the metal layer with the material of the plates.

According to an embodiment of the invention, the sealing joint is formed by a frame made of a ductile metal interposed between the plates.

According to an embodiment of the invention, the sealing joint is formed by a rigid frame, whose size is slightly smaller than the size of the plates, and is interposed between the two plates, and by a layer of vacuum grease placed in the volume delineated by the free surface of the frame and the protrusions of the plates with respect to the frame.

According to an embodiment of the invention, the vacuum grease layer is insulated from the outside of the screen by a sealing gel.

According to an embodiment of the invention, means for preventing the plates from sliding over the sealing joint are placed around the plates.

According to an embodiment of the invention, an electrical insulation layer is interposed between the sealing joint and each of the plates.

According to an embodiment of the invention, the thickness of the sealing joint is selected so as to correspond, after sealing, to the thickness of the inter-plate gap defined by spacers distributed on at least one of the plates.

The invention also relates to an equipment for assembling two parallel plates constituting respectively the bottom and the viewing surface of a flat display screen, including:

at least one input airlock chamber communicating with a vacuum chamber or a chamber in an inert atmosphere;

at least one tunnel furnace thermal degassing process of the plates;

means for transferring under a vacuum a first plate from the outside of the tunnel furnace toward an electronic bombardment burn-in section;

means for transferring under a vacuum the first plate from the burn-in section toward a sealing section;

means for transferring under a vacuum a second plate from a thermal processing section toward said sealing section; and at least one output airlock chamber for progressive transfer to atmosphere.

The foregoing and other objects, features, aspects and advantages of the invention will become apparent from the following detailed description of the present invention when taken in conjunction with the accompanying drawings.

FIGS. 1 and 2, above described, explain the state of the art and the problem encountered;

FIG. 3 schematically represents an equipment for implementing the method according to the invention;

For the sake of clarity, the figures are not drawn to scale and the same elements are designated with the same reference characters in the various figures.

A distinctive feature of the method according to the invention is to enable a burn-in step of the anode, using an electronic bombardment source that is distinct from the cathode which is subsequently associated therewith, while preventing the anode from being vented between the burn-in step and the assembly with a cathode.

Figure 1:
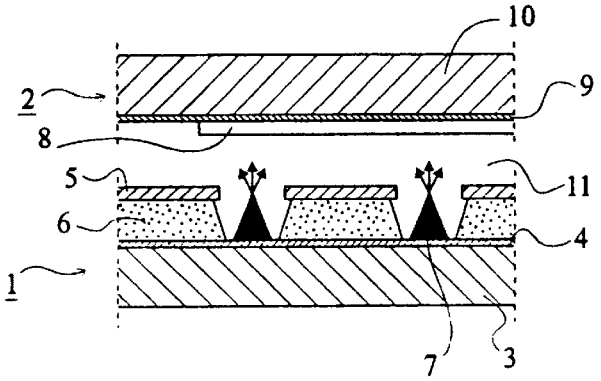
Figure 2:
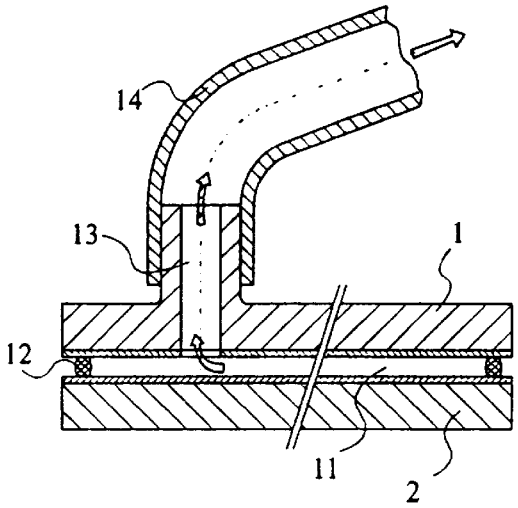
Figure 3:
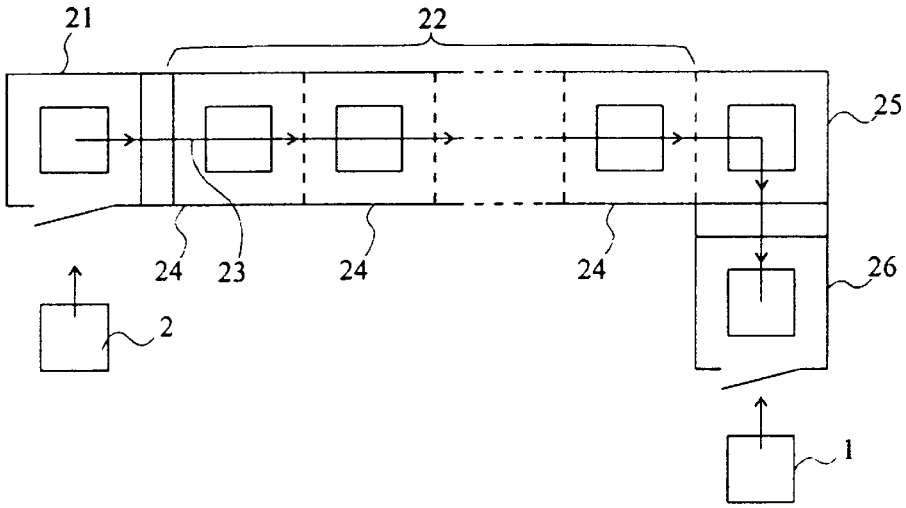

FIG. 3 schematically illustrates an implementation of the method according to the invention, and represents the structure of an equipment which can be used for implementing the processes to be applied to an anode plate until it is assembled to a cathode plate.

According to the invention, an anode plate 2 is introduced into an input airlock chamber 21 of a tunnel furnace 22. Although only one airlock chamber 21 is represented in FIG. 3, the introduction is preferably achieved by progressively making a vacuum within a plurality of input airlock chambers. In airlock chamber 21, plate 2 is placed under a high vacuum of approximately $10^{-8}$ Pa. Plate 2 is then conveyed by a suitable conveyor 23 toward a first thermal processing section 24 of the tunnel furnace 22. Plate 2 is then conveyed inside the tunnel furnace 22, for a progressive increase in temperature up to approximately 450° C., then progressively decreased in temperature down to 100° C. to 200° C. in the last section of furnace 22. Using a tunnel furnace 22 enables to serially process a plurality of anode plates 2 which are successively conveyed from one section to another.

After being subjected to a thermal process in a vacuum or an oxygen plasma, to eliminate a portion of the organic pollutants of the phosphors, plate 2 is conveyed toward an electronic bombardment section 25. This transfer is achieved under a vacuum or in an inert atmosphere to prevent the organic pollutants naturally present in the air from polluting the phosphors.

A characteristic of the electronic bombardment which causes free carbons or other organic pollutants to be generated lies in the fact that it is no longer achieved by the microtip cathode associated with the anode, but with an independent source (not shown). It can be, for example, a dedicated microtip cathode, especially designed to achieve this function, or a conventional scanning electron gun.

An advantage of such an electronic bombardment is that it allows an optimal burn-in performance of the anode by enabling to place the anode at a significant distance (approximately a few tens of a centimeter) from the bombardment source. Thus, the energy of the electrons emitted either by the gun or by the microtips of the dedicated cathode, can be much more important, which allows a faster (for example approximately one hour) and significantly more efficient burn-in step.

In the case of bombardment by a dedicated microtip cathode, the voltage difference between the anode and the cathode is significantly higher than in the operation conditions of the screen. The distance between the anode and the burn-in cathode allows an increase of the anode-cathode voltage without risks for electric arcs to occur.

In the case of bombardment by an electron gun, the voltage difference between the anode and the gun is approximately 10 kV.

The distance between the anode and the electronic bombardment source also allows to better eliminate by suction the compounds (free carbons and others) generated during the burn-in step without causing excessive pollution on the bombardment source.

After the burn-in step of the anode, plate 2 is conveyed, still under a vacuum or inert atmosphere, toward a sealing section 26. A microtip cathode/gate plate 1, independently subjected to vacuum thermal degassing and evaporation of the spacers' glue, is introduced into the sealing section 26. Plate 1 is introduced into the sealing section 26, like plate 2, still under a vacuum after its thermal processes. The thermal processing of the cathode/gate plate 1 can be achieved inside a tunnel furnace (not shown) similar to the tunnel furnace 22 for processing anode 2.

Optionally, the sealing section 26 can correspond to the burn-in section 25. The sealing section 26 is provided with a press (not shown). The cathode/gate and anode plates 1 and 2 are placed on respective jaws of the press.

The assembly is achieved under a vacuum to not pollute the anode after its burn-in step. Since the conventional sealing process with a fusible glass seam requires a thermal process causing degassing of the fusible glass polluting the anode, the invention provides a new method for cold sealing the two plates together.

Although the above description refers to an anode plate 2 and a cathode/gate plate 1 that are conveyed in the assembly device, in practice, a plurality of anode and cathode/gate plates placed on suitable supports are simultaneously processed in each section.

Figure 4:
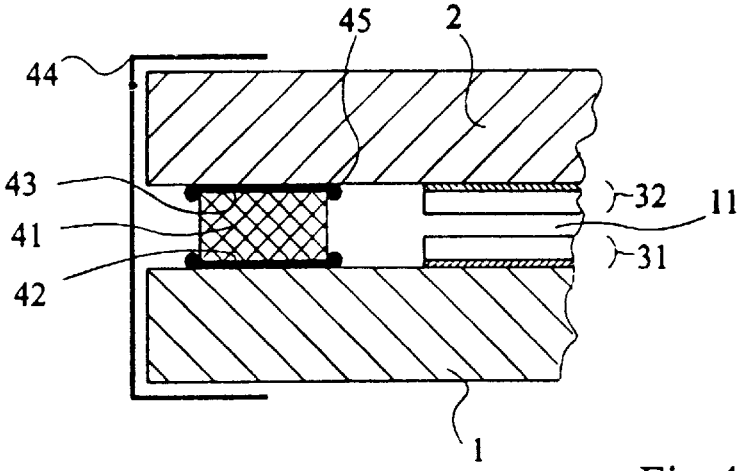
FIG. 4 is a partial cross-sectional view of the structure of a sealing joint of a microtip screen according to a first embodiment of the invention.
Figure 5:
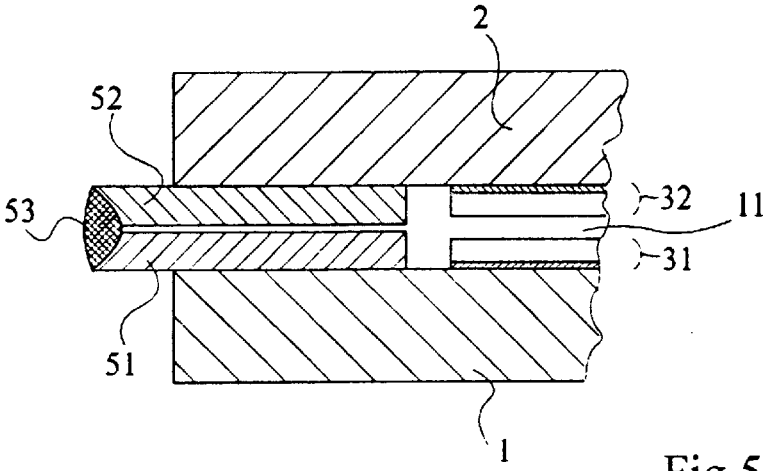
FIG. 5 is a partial cross-sectional view of the structure of a sealing joint of a microtip screen according to a second embodiment of the invention.
Figure 6:
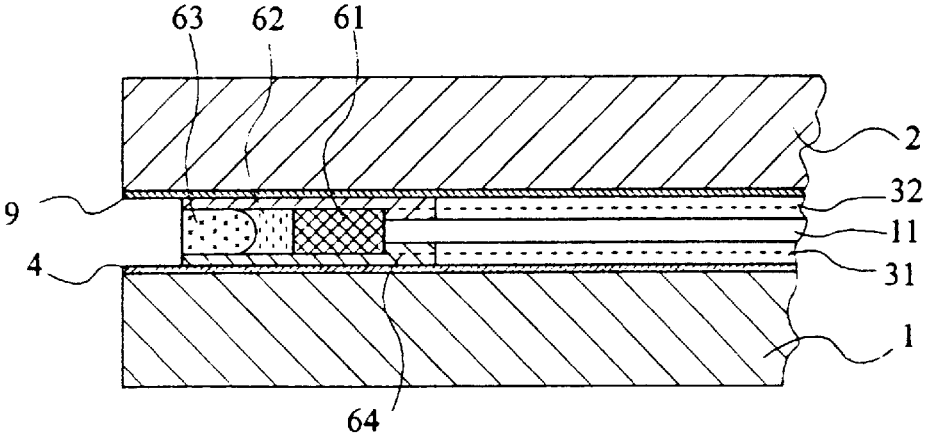
FIG. 6 is a partial cross-sectional view of the structure of a sealing joint of a microtip screen according to a third embodiment of the invention.

Various embodiments for the sealing of plates 1 and 2 are illustrated in FIGS. 4–6. For the sake of clarity, the detailed structure of the assembly of cathode/gate 1 and anode 2 are only symbolically represented in the figures as layers 31 and 32.

FIG. 4 illustrates a first embodiment of the sealing joint of the anode and cathode plates 1 and 2, respectively. Sealing is achieved by a rigid peripheral frame 41. Frame 41 is, for example, made of metal and is coated on its both surfaces designed to contact plates 1 and 2 with layers 42, 43 made of metal fusible at low temperature. The thickness of the rigid frame (for example 0.2 mm) substantially corresponds to the height of the spacers (not shown) distributed over the gate. The thickness of layers 42, 43 ranges, for example, approximately from 2 $\mu$m to 5 $\mu$m.

Once plates 1 and 2 are pressed against the frame 41 by the press provided in the sealing section 26, they are inductively heated at their periphery to cause layers 42 and 43 to be fused.

Preferably, insulating layers (not shown) are interposed between frame 41 and plates 1 and 2. The insulating layers insulate from frame 41 the electrical connection paths of the cathode, gate, and anode conductors 4, 5 and 9, respectively. The insulating layers are, for example, made of silicon oxide ($SiO_2$) deposited by chemical vapor deposition.

Once sealing is completed, the screen is assembled and vented. Removal from the vacuum chamber is preferably progressively made through a plurality of airlock chambers to not pollute the vacuum of the sealing section 26.

Optionally, once the screen is removed from the vacuum chamber, a peripheral belt or clips 44 can be added to prevent plates 1 and 2 from sliding over frame 41. This anti-sliding function can also be achieved by the fusible metal layers 42, 43, because, when flattened by the press, they create protrusions 45 that form abutments.

FIG. 5 illustrates a second embodiment of a sealing joint according to the invention. Two peripheral foils 51, 52, for example made of stainless steel, are respectively fixed on the inner surfaces of plates 1 and 2, before they are introduced for degassing into the vacuum chamber. Foils 51, 52 are sealed to plates 1 and 2, for example by glass-metal welding or soldering on a metal deposition (not shown) previously achieved at the periphery of plates 1 and 2. Foils 51 and 52 are sealed so as to protrude over the whole periphery of plates 1 and 2. The thickness of each foil 51 or 52 corresponds to one half of the desired distance between plates 1 and 2 of the screen and defined by the spacers distributed over gate 5. The compounds that may form possible pollutants for anode 2 or cathode 1 are removed during the thermal process steps to which plates 1 or 2 are subjected under a vacuum or oxygen plasma.

Once plates 1 and 2 are pressed together in the sealing section 26, the portions of foils 51 and 52 protruding from the surface of plates 1 and 2 are welded together (53), for example by laser fusion. The foils are thus sealed at the periphery and the inter-electrode gap 11 is insulated from outside. The screen can be removed from the vacuum chamber as disclosed with relation to FIG. 4.

In order to electrically insulate foils 51 and 52 from the electrical connection paths of cathode, gate and anode conductors, an insulating peripheral layer (not shown) can be interposed between each foil and plate 1 or 2 associated therewith.

FIG. 6 illustrates a third embodiment of the sealing joint according to the invention. A frame 61, made of a rigid material that does not degas under a vacuum, is interposed between plates 1 and 2 that protrudes with respect to this frame. Frame 61 is, for example, made of a stainless steel foil or glass. Frame 61 is installed before pressing plates 1 and 2 together.

Once plates 1 and 2 are pressed against frame 61, a vacuum grease 62 is deposited into the gap delineated by the external free surface of frame 61 and the protrusions of plates 1 and 2 with respect to frame 61. The vacuum grease 62 is selected sufficiently fluid to avoid possible micro-leaks along frame 61. Preferably, the vacuum grease 62 is selected to be compatible with the vacuum and to be air-steady. If the vacuum grease is not air-steady, the application of a sealing gel 63, made for example of a glue including silicon, allows insulation of the vacuum grease 62 from the air.

In the case where frame 61 is made of a conductive material, an insulating layer 64 is interposed between frame 61 and the contacting areas of plates 1 and 2. The role of the insulating layer 64 is still to electrically insulate frame 61 from the electrical connection paths of the cathode, gate and anode conductors 4, 5 and 9 respectively.

The removal of the screen from the vacuum chamber, which is achieved as disclosed with relation to FIG. 4, maintains in this case plates 1 and 2 further to pressure difference. The relative pressure difference, between the inter-electrode vacuum gap of the screen and the outside of the screen, maintains plates 1 and 2 pressed against frame 61, thus ensuring sealing between the inter-electrode gap 11 and the outside. A belt or clips can also be provided to prevent plates 1 and 2 from sliding on the frame.

A fourth embodiment (not shown) of the sealing joint according to the invention provides a peripheral joint fabricated with a ductile metal, such as annealed copper or silver. The joint is interposed between plates 1 and 2 and is pressed with the press of the sealing section 26. Preferably, the insulating layers are interposed between the joint and the plates to insulate the electrical connection paths of the cathode, gate and anode conductors from the sealing joint.

Once the joint is pressed, the assembled screen is put to air as disclosed with relation to FIG. 4. As in the case of the third embodiment, the relative pressure difference, between the inter-electrode vacuum gap of the screen and the outside of the screen, maintains the joint pressed, which ensures tightness between the inter-electrode gap and the outside.

A peripheral belt or clips can also be added to prevent plates 1 and 2 from sliding on the joint.

The implementation of the invention substantially increases the life-time of the screen by practically avoiding outgassing of the anode during the operation of the screen. The invention also increases the brightness of the screen by avoiding pollution of the cathode by organic compounds, which were eliminated prior to the assembly of the plates. In addition, the method according to the invention eliminates the need for a pumping tube to generate a vacuum and permits degassing of the inter-electrode gap, which significantly decreases the overall size of the screen. The elimination of subsequent risks of degassing further enables, if desired, to eliminate the getter.

The assembling method according the invention is much faster than conventional processes, more particularly because the burn-in step of the anode is achieved before assembling, by a dedicated bombardment source.

As is apparent to those skilled in the art, various modifications can be made to the above disclosed preferred embodiments. More particularly, each component described for the sealing joint can be replaced with one or more components performing the same function.

Furthermore, although the description refers to a microtip screen, the invention also applies to any flat display screen that requires a degassing step and includes an inner chamber which is under a vacuum or filled with a low pressure gas.

The detailed processes to which the two plates must be subjected depend on the type of the screen and can be performed by those skilled in the art. More particularly, the choice between a thermal process under a vacuum or a plasma depends on the compounds generated during the degassing step. Similarly, the burn-in step of the anode by electronic bombardment can also be achieved at a higher temperature to accelerate the process.

In addition, the choice between the transfer under a vacuum or an inert atmosphere of the plates between the various sections of the installation depends on the equipment thereof, provided that the plates are not put to air between the various sections. If, for example, the plates must be manually transferred or handled. Preferably, transfer is performed in inert atmosphere to enable handling in a glove box.

We claim:

1. A method for assembling two parallel plates (1, 2) respectively forming the bottom and the face of a flat display screen including a degassing step of the plates (1, 2) and a vacuum burn-in step, the method including the following steps:

subjecting a first plate (2) to a burn-in step by electronic bombardment, moving under a vacuum the first plate so as to face a second plate (1), and assembling the two plates (1, 2) with a specific peripheral sealing joint.

2. The method of claim 1, wherein each plate (1, 2) is independently subjected to a degassing thermal process before being assembled together, the first plate (2) being subjected to a burn-in step after a thermal processing.

3. The method of claim 1 or 2, wherein the plates (1, 2) respectively support the cathode/gate assembly and the anode of a microtip screen.

4. The method of claim 3, wherein the burn-in step of the anode is achieved by an electronic bombardment source that is distinct from the cathode to which it is subsequently assembled.

5. The method of claim 4, wherein the electronic bombardment source is an electron gun.

6. The method of claim 4, wherein the electronic bombardment source is formed by a dedicated microtip cathode for electronic emission, disposed at a distance from the anode that is significantly higher than the distance separating the anode from the cathode of an assembled screen, the anode-cathode voltage applied during the burn-in step being substantially higher than the operation voltage of the screen.

7. The method of claim 1, wherein the sealing joint is formed by two foils (51, 52) fixed on the inner surface of the plates (1, 2) and protruding from the periphery of the plates, the protrusion forming an area (53) for welding together the foils after pressing the plates together, each foil being welded to one of the plates before the thermal degassing step of the plates.

8. The method of claim 7, wherein each foil (51, 52) is welded to a plate (1, 2) after deposition of a metal layer on the inner periphery of the plate.

9. The method of claim 7, wherein an electrical insulation layer (64) is interposed between the sealing joint and each of the plates (1, 2).

10. The method of claim 7, wherein the thickness of the sealing joint is selected so as to correspond, after sealing, to the thickness of the inter-plate gap (11) defined by spacers distributed on at least one of the plates (1, 2).

11. The method of claim 1, wherein the sealing joint is a rigid frame (61), whose size is slightly smaller than the size of the plates (1, 2), and is interposed between the plates (1, 2), and by a layer of vacuum grease (62) placed in the volume delineated by the free surface of the frame and the protrusions of the plates with respect to the frame.

12. The method of claim 11, wherein the vacuum grease layer (62) is insulated from the outside of the screen by a sealing gel (63).

13. The method of claim 11, wherein means (44) for preventing the plates (1, 2) from sliding over the sealing joint (41, 61) are placed around the plates.

14. The method of claim 1, wherein the sealing joint is formed by a rigid frame (41) interposed between the two plates (1, 2) and coated over its surfaces facing the plates with a metal layer (42, 43) fusible at low temperature, the sealing being achieved by an inductive heating fusion of the metal layer with the material of the plates (1, 2).

15. The method of claim 1, wherein the sealing joint is formed by a frame made of a ductile metal interposed between the plates (1, 2).

16. An equipment for assembling two parallel plates (1, 2) respectively constituting the bottom and the viewing surface of a flat display screen, including:

at least one input airlock chamber (21) communicating with a vacuum chamber or a chamber in an inert atmosphere;

at least one tunnel furnace (22) for thermal degassing of the plates (1, 2);

means (23) for transferring under a vacuum a first plate (2) from the outside of the tunnel furnace toward an electronic bombardment burn-in section (25);

means (23) for transferring under a vacuum the first plate (2) from the burn-in section (25) toward the sealing section (26);

means for transferring under a vacuum a second plate (1) from a thermal processing section toward a sealing section (26); and at least one output airlock chamber for progressive transfer to atmosphere.

* * * * *